United States Patent [19]

Bartelmuss et al.

[11] Patent Number: 4,909,906

[45] Date of Patent: Mar. 20, 1990

[54] COVER PIECE FOR A SUCTION BOX WITH WAVELIKE OR ZIGZAG PASSAGE

[75] Inventors: Klaus Bartelmuss, Styria, Austria; Alexander Gauss, Chesapeake, Va.

[73] Assignee: IBS Kunststoffwerk Ing. Heinrich Bartelmuss, Steiermark, Austria

[21] Appl. No.: 304,363

[22] Filed: Jan. 30, 1989

[30] Foreign Application Priority Data

Oct. 6, 1988 [AT] Austria ..... 2473/88

[51] Int. Cl.[4] ..... D01F 1/48

[52] U.S. Cl. ..... 162/374; 162/352

[58] Field of Search ..... 162/352, 374

[56] References Cited

U.S. PATENT DOCUMENTS

| | | | |
|---|---|---|---|
| 2,896,711 | 7/1959 | Prevost | 162/374 |
| 2,957,522 | 10/1960 | Gatke | 162/374 |
| 3,218,228 | 11/1965 | Wagenknight | 162/374 |
| 3,940,308 | 2/1976 | Blanchfield | 162/374 |
| 4,164,442 | 8/1979 | Bartelmuss | 162/352 |
| 4,319,957 | 3/1982 | Bartelmuss | 162/352 |
| 4,443,298 | 4/1984 | Thorp | 162/352 |

*Primary Examiner*—Karen M. Hastings

*Attorney, Agent, or Firm*—Herbert Dubno

[57] ABSTRACT

The cover piece for a suction box of a dewatering unit for a fleece made of a pulp material conveyed over the suction box on an endless conveyor belt is provided with at least one zigzag or wavelike passage extending substantially transversely to the conveyor belt travel direction composed of a plurality of passage portions inclined to the travel direction of the conveyor belt and distributed on both sides of the medium plane of the cover piece. Advantageously the distance across the passage in the travel direction of the conveyor belt is maintained constant so that the open surface area per unit length across the passage is substantially constant, although the width across the passage may differ for portions of the passage which widen in the conveyor belt travel direction and portions which constrict in the conveyor belt travel direction.

7 Claims, 4 Drawing Sheets

18'
1
2
3
4
5
6
7
M
R
S1
S2
8
α
β

COVER PIECE FOR A SUCTION BOX WITH WAVELIKE OR ZIGZAG PASSAGE

FIELD OF THE INVENTION

Our present invention relates to an improved cover piece for a suction box in a dewatering unit used in the manufacture of paper from a fleece.

BACKGROUND OF THE INVENTION

The cover piece for a suction box for fleece dewatering in accordance with current practice, can be positioned transverse to the running direction of an endlessly circulating conveyor for a fleece made of a pulp material. This cover piece has a plurality of parallel dewatering passages or slots inclined to the running direction of the conveyor belt and located on both sides of the medium plane of the cover piece.

In this prior art cover piece the slots are arranged at a 45° angle to the running direction of the conveyor belt so that they are distributed symmetrically and on both sides of the cover piece medium plane.

With such inclined slots a tensioning action is exerted on the conveyor belt for the fleece (i.e. a dewatering screen or paper making felt) transverse to the running direction.

In the cover piece most often used heretofore a plastic material is used in construction so that a comparatively rapid wearing process is effected and the cover piece fairly quickly loses its ability to function properly.

With a ceramic construction, of course, the cover piece is practically completely free of wear but there is much more wear on the conveyor belt (felt or wire screen) especially at the transition region at the slot ends from the straight slot wall to a rounded slot wall. The transition regions can only be made by hand so that irregularities in the structure of the transition region cannot be avoided.

OBJECTS OF THE INVENTION

The principal object of the invention is to provide an improved dewatering vacuum box with a cover piece which overcomes the aforementioned drawbacks.

It is another object of our invention to provide an improved cover piece for the suction box for dewatering which has surfaces made of a hard material, e.g. a ceramic oxide, which provides the desired tensioning effect on the conveyor belt but without the increased wear on the conveyor belt which has characterized cover plates made of hard wear-resistant material heretofore.

SUMMARY OF THE INVENTION

This object and others which will become more readily apparent hereinafter is attained in accordance with our invention in a cover piece for a suction box for dewatering a fleece made of a paper making pulp.

According to our invention a wavelike or zigzag passage is provided in the cover piece for dewatering.

According to a feature of our invention adjacent portions of the zigzag or wavelike passage of the cover piece have different angles with respect to the travel direction of the belt.

One portion of each undulation advantageously can, for example, be at an angle of about 45° with respect to the conveyor belt travel direction, while the other can be at an angle of about 15° with respect to the travel direction.

Because of this choice of angle a particularly good tensioning effect on the conveyor belt transverse to the travel direction and thus on the fleece located on it is effected.

Another embodiment of our invention is characterized by the width of one portion of the passage inclined toward the conveyor belt transport direction being different from the width of another adjacent portion inclined away from the travel direction. In this embodiment of our invention the width of the passage varies with the tapering or constriction of the passage so that over the entire extent of the cover piece transverse to the conveyor belt travel direction the same open surface area (suction surface, i.e. open surface area per unit length across the cover piece)) is guaranteed.

Another change of effective suction cross section can be attained in a simple way when according to a preferred embodiment of our invention both the walls bounding the passages can be formed by the cover plates protruding toward each other from the passage edges which are moveable toward each other. These cover plates are mounted on the suction box especially transverse to the conveyor belt travel direction to change the width of the passage.

Our invention provides zigzag or wavelike passages in the cover plate or cover bar or cap which can be combined with other slot shapes. Thus it is advantageous when the zigzag or wavelike passage is located upstream or downstream in the conveyor belt travel direction of at least one linear dewatering slot, especially a linear dewatering slot that extends substantially over the entire extent of the cover piece transverse to the conveyor belt travel direction.

Means for adjusting the conveyor belt to the fleece width can be provided on the cover piece including a linear section of the passage at one end of the passage in which a plug-in member or insert which sets a particular fleece width can be provided.

BRIEF DESCRIPTION OF THE DRAWING

The above and other objects, features and advantages of our invention will become more readily apparent from the following description, reference being made to the accompanying highly diagrammatic drawing in which.

SPECIFIC DESCRIPTION

Figure 7:
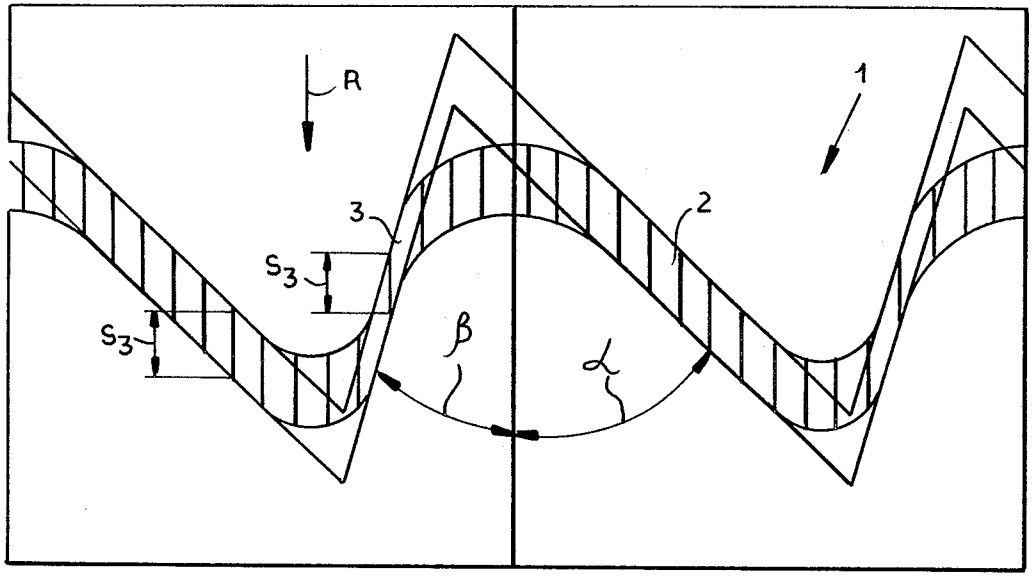
FIG. 7 is a detail top plan view of a portion of the cover pieces of FIGS. 1 and 2.
Figure 8:
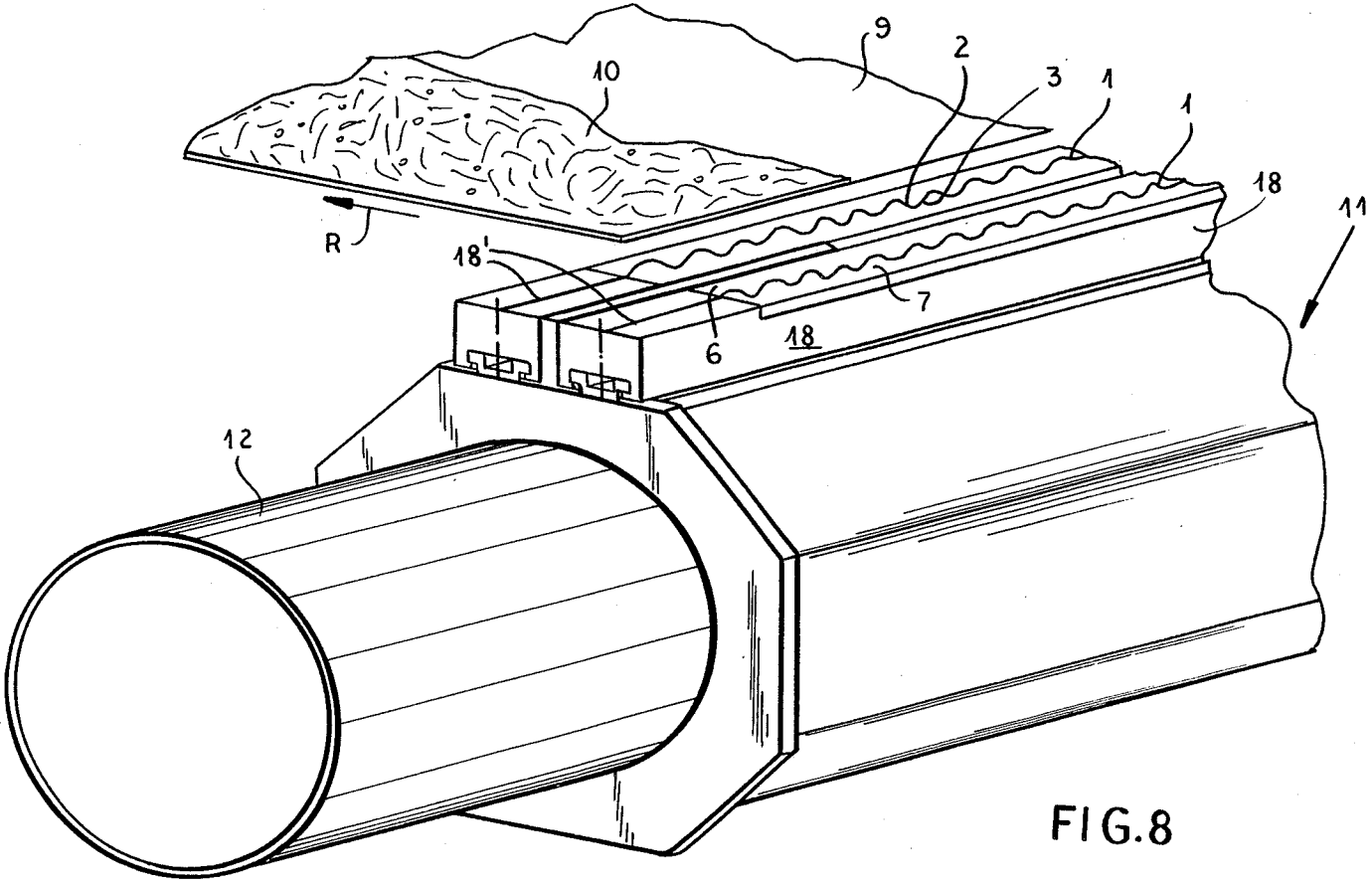
FIG. 8 is a perspective view of a suction box of a dewatering unit for a fleece having two cover pieces according to our invention.

In the drawing, especially FIG. 8, the cover piece of a suction box 11 for dewatering a fleece 10 made of a pulp material is shown. The fleece 10 is conveyed over the cover piece in the travel direction R of conveyor belt 9 for the fleece 10. This cover piece is shown in a plan view for various embodiments in FIGS. 1 to 7.

The conveyor belt 9 can be a felt belt (papermaker's felt) or a wire web or screen. The cover piece has slots inclined to the travel direction R which connect to form a zigzag or wavelike passage 1 through the cover piece. Understandably a number of these passages 1 can be provided in succession following each other in the travel direction R. The latter embodiment has not been illustrated in the drawing.

The adjacent portions 2,3 of the zigzag or wavelike passage 1 of the cover piece are oriented at a diverging angle ($\alpha+\beta$) with respect to each other (these angles being measured with reference to the conveyor belt travel direction R) as is apparent from FIGS. 1, 2, 5 and 7. In the embodiment shown in FIGS. 2 and 7 the portion 2 takes an angle $\alpha$ of advantageously 45° with respect to the conveyor belt travel direction and the other portion 3 an angle $\beta$ of 15°.

Figures 1, 2, 3, 4, 5:
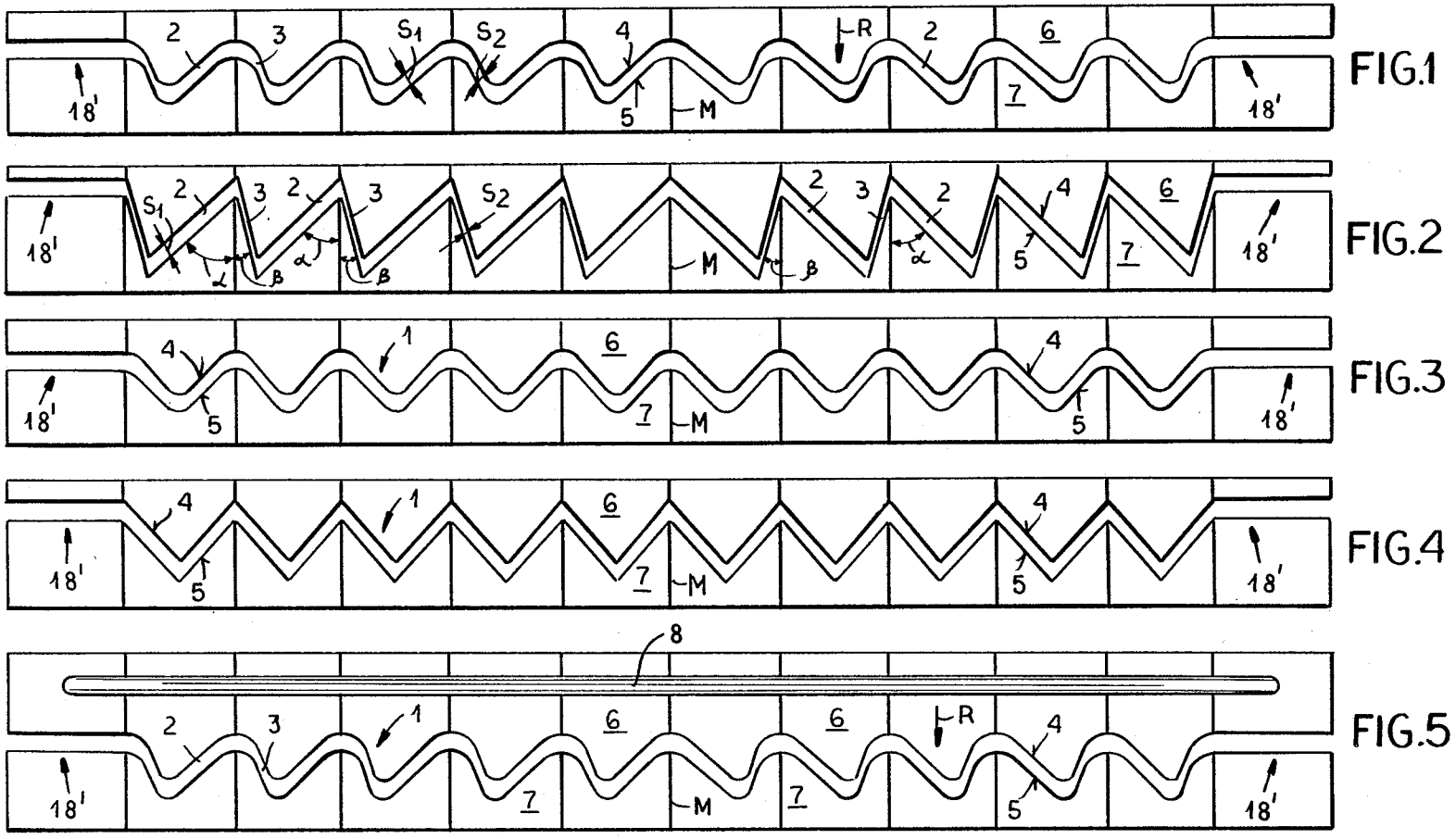
FIGS. 1 to 5 are respective top plan views of different embodiments of the cover piece according to our invention.

In the embodiment of FIGS. 1, 5 and 7 the width S1 of the passage 1 is different in the portion 2 expanding in the conveyor belt travel direction R than the width S2 of the passage 1 in the portion 3 contracting in the travel direction R. It is important to realize as shown in FIG. 1 that the width at any place across the passage 1 is measured perpendicular to the wall surface at that point. For example in FIG. 7 the distance S3 between opposing walls in the conveyor belt travel direction R is constant but the width S1, S2 across the passage 1 changes. Thus in the wavelike embodiment shown the open surface area per unit length along a direction transverse to the travel direction R is substantially constant.

The passage 1 is bounded by the walls 4, 5 which are formed by the cover plates 6, 7 protruding toward each other from the edges. Thus a cover plate extending substantially over the entire width of the conveyor belt transverse to the travel direction R can be provided.

However it is advantageous to arrange several cover plates 6, 7 side-by-side over the transverse width of the cover piece. The distance or spacing S3 of both walls 4, 5 bounding the passage 1 in the conveyor belt travel direction R is—as indicated clearly in FIG. 7—substantially equal at all positions on the cover piece.

To change the width of the passage 1 the cover plates 6, 7 can be moveable relative to each other on the suction box 11, especially in the direction of the arrow Q parallel to the conveyor belt travel direction. For adjustment, bevel gears 13 can be provided which are driven by a common shaft 14 which can be rotated manually by a handle 15. For adjustment of the plates 7 threaded spindles 16 are provided which engage in nuts (not shown) which are attached to the plates 7 of the common supporting members 18 for the plates 7. The plates 6 are mounted so as to be stationary. The mounts for the threaded spindles 16 are indicated with the reference character 17.

In the embodiment of FIG. 5 the wavelike passage 1 is located upstream of a substantially linear slot 8 in the travel direction R and extends substantially over the entire width of the cover plate transverse to the conveyor belt travel direction R. In fact several slots 8 can be provided. Similarly the passage 1 can also be located downstream of the linear slots 8 in the travel direction R.

Figure 6:
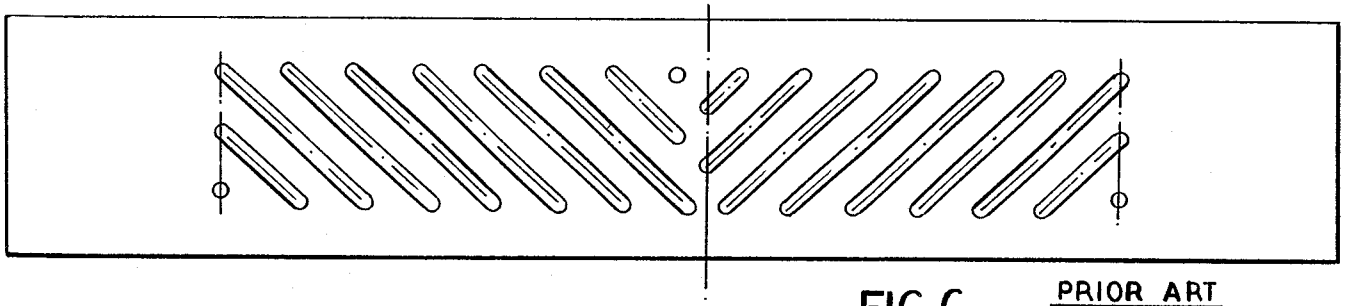
FIG.6 PRIOR ART
FIG. 6 is a top plan view of a conventional currently used cover piece for the suction box of a dewatering unit used to dewater a fleece.

FIG. 6 shows a conventional structure for the cover plate which has a plurality of slots inclined to the running direction R of the conveyor belt. The structure, particularly when a ceramic oxide cover piece is used, has the disadvantage that sharp edges are formed at the ends of the individual slots which can give rise to damage to or at least to an increased wear of the conveyor belt.

The width S2 and/or S1 of the passage 1 advantageously amounts to between 0.01 mm and 25mm. The plates 6, 7 can be made advantageously from aluminum oxide, zirconium oxide, silicon carbide, silicon titanate, silicon nitride or other hard wear-resistant material. The plates 6, 7 are thus mounted on a single-piece continuous supporting member 18 which is held on the suction box 11. The edges of the passage 1 which run wavelike or zigzag can have broken and/or rounded edges for additional protection of the conveyor belt.

In FIG. 8 the suction line 12 leading to the unshown suction pump is connected to the suction box 11.

Figure 9:
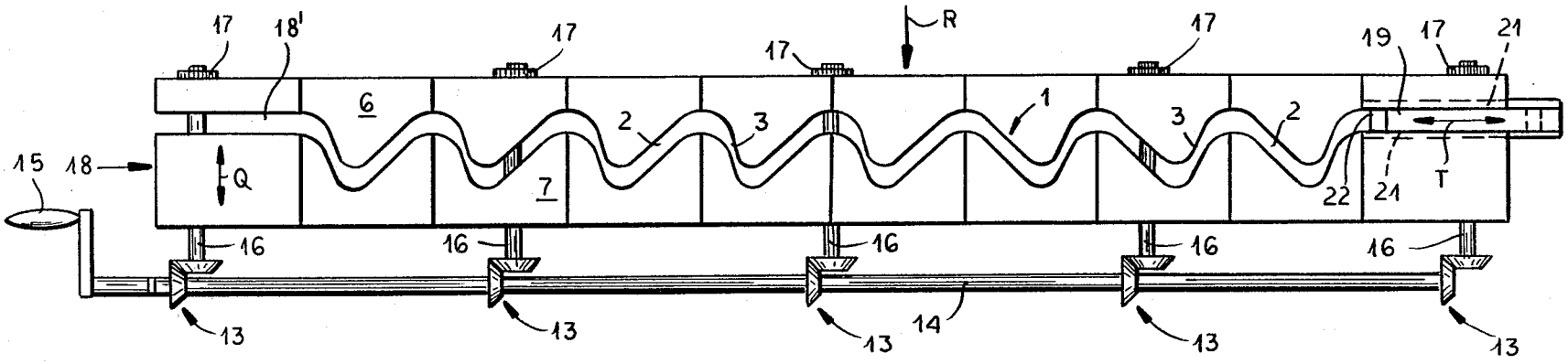
FIG. 9 is a top plan view of another embodiment of the cover piece according to our invention with an adjustable width passage.
Figure 10:
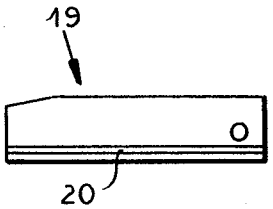
FIG. 10 is a side elevational view of a component of the embodiment shown in FIG. 9.
Figure 11:
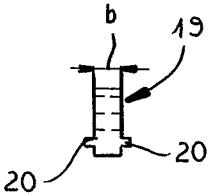
FIG. 11 is a different side elevational view of the component shown in FIG. 10.

In the embodiment of FIG. 9 the zigzag and/or the wavelike passage 1 has at one end, and in this embodiment advantageously at both ends, a section 18' of the passage 1 running linearly transverse to the conveyor belt travel direction R in which a strip-like plug-in manner 19 engages for size adjustment (fleece width control). This plug-in or insert 19 has guide strips 20 protruding from its lateral surfaces which engage in the guide grooves 21 of the supporting member 18 so that the plug-in or insert 19 can be pushed manually in the direction of the arrow T (FIG. 9) and thus its front wall 22 can take different positions or spacing from the cover piece medium so that the width of the fleece (paper web) can be adjusted. In so far as the width of the passage is changeable (FIG. 9), the plug-ins or inserts 19 must be provided as a set with a stepped width b so that after each adjustment of the slot width a fitting plug-in or insert 19 can be inserted in the linear section 18'.

We claim:

1. In a machine for dewatering a pulp fleece including an endlessly circulating conveyor belt having a direction of travel, a cover piece on a suction box for pulp fleece dewatering, said suction box being mounted transverse to the travel direction of the endlessly circulating conveyor belt for said pulp fleece, said cover piece being provided with a wavelike or zigzag passage extending in a direction substantially transverse to said travel direction of said conveyor belt comprising a plurality of adjacent connected portions and defined by two facing walls, two adjacent ones of said portions being oriented at an angle diverging from each other, one of said portions being at an angle of about 45' to said conveyor belt travel direction and the other of said portions being at an angle of 15° to said travel direction, the width of said one portion of said passage being different from the width of said other adjacent portion and a distance in said conveyor belt travel direction between the facing walls of said passage being substantially constant, each of said passages having a substantially linear section on at least one end extending transverse to said travel direction of said conveyor belt in which a plug-in or insert is mounted for size adjustments of said fleece.

2. In a machine for dewatering a pulp fleece including an endlessly circulating conveyor belt having a direction of travel, a cover piece on a suction box for pulp fleece dewatering located transverse to the travel direction of the endlessly circulating conveyor belt for said pulp fleece with a plurality of continuous dewatering slots located transverse to said travel direction of said conveyor belt and located on both sides of a medium plane of said cover piece, the improvement wherein each of said dewatering slots form a zigzag or wavelike passage in said conveyor piece, each slot being bounded by two walls which define said passage, two adjacent portions of said zigzag or wavelike passage are oriented at an angle diverging from each other, one of said portions being at an angle of about 45° to said travel direction of said conveyor belt and the other of said portions being at an angle of 15° to said travel direction, and the width of said one portion of said passage is different from the width of said other portion of said passage.

3. The improvement defined in claim 2 wherein both walls bounding said passage are formed by a plurality of cover plates protruding toward each other which are moveable relative to each other in said conveyor belt direction and are mounted on said suction box to change the width of said passage.

4. The improvement defined in claim 2 wherein said zigzag or wavelike passage is located upstream or downstream with respect to said travel direction of at least one additional substantially linear dewatering slot extending transverse to said travel direction of said conveyor belt.

5. The improvement defined in claim 4 wherein said additional substantially linear dewatering slot extends almost over the entire extent of said cover piece in a direction transverse to said conveyor belt travel direction.

6. The improvement defined in claim 2 wherein said zigzag or wavelike passage has a substantially linear section on at least one end extending substantially transverse to said conveyor belt travel direction in which a plug-in or insert is mounted for size adjustments of said fleece.

7. The improvement defined in claim 6 wherein said plug-in or said insert is adjustable manually.

* * * * *